US007774865B2

(12) United States Patent
Miller

(10) Patent No.: US 7,774,865 B2
(45) Date of Patent: Aug. 17, 2010

(54) ATHLETIC SUPPORT GARMENT

(76) Inventor: Regg Miller, 2024 Malbrook Road, Oakville, Ontario (CA) L6J 1Y7

( * ) Notice: Subject to any disclaimer, the term of this patent is extended or adjusted under 35 U.S.C. 154(b) by 46 days.

(21) Appl. No.: 11/106,586

(22) Filed: Apr. 15, 2005

(65) Prior Publication Data

US 2005/0229293 A1 Oct. 20, 2005

(30) Foreign Application Priority Data

Apr. 15, 2004 (CA) ..... 2464782

(51) Int. Cl.
*A41B 9/02* (2006.01)

(52) U.S. Cl. ..... 2/403; 2/400

(58) Field of Classification Search ..... 2/400, 2/403, 405, 404, 78.1, 73, 109, 113
See application file for complete search history.

(56) References Cited

U.S. PATENT DOCUMENTS

| | | | | | |
|---|---|---|---|---|---|
| 2,239,972 | A | * | 4/1941 | Rauser | 2/403 |
| 2,519,534 | A | * | 8/1950 | Artzt | 66/175 |
| 2,641,257 | A | * | 6/1953 | Rutledge | 602/67 |
| 2,664,889 | A | * | 1/1954 | Bailey | 602/67 |
| 3,083,710 | A | * | 4/1963 | Rauser | 602/67 |
| 3,312,981 | A | * | 4/1967 | McGuire et al. | 2/406 |
| 4,679,554 | A | | 7/1987 | Markham | 128/158 |
| 4,880,424 | A | * | 11/1989 | Rautenberg | 604/396 |
| 4,989,594 | A | | 2/1991 | Doherty et al. | 128/158 |
| 5,003,972 | A | | 4/1991 | Kestler | 128/158 |
| 5,098,419 | A | * | 3/1992 | Gold | 604/396 |
| 5,131,100 | A | * | 7/1992 | Atwater et al. | 2/405 |
| 5,157,793 | A | | 10/1992 | Michels | 2/403 |
| 5,210,882 | A | * | 5/1993 | Moretz et al. | 2/404 |
| 5,274,854 | A | * | 1/1994 | Wenner et al. | 2/403 |
| 5,819,323 | A | | 10/1998 | Edenfield | 2/466 |
| 5,875,495 | A | * | 3/1999 | Thrower | 2/403 |
| 6,041,441 | A | * | 3/2000 | Counts et al. | 2/227 |
| 6,047,408 | A | * | 4/2000 | Brill, Jr. | 2/403 |
| 6,287,169 | B1 | * | 9/2001 | Willms et al. | 450/101 |
| 6,613,034 | B2 | * | 9/2003 | Nozaki et al. | 604/396 |
| 6,848,121 | B1 | * | 2/2005 | Halid | 2/400 |

* cited by examiner

*Primary Examiner*—Katherine Moran
*Assistant Examiner*—Richale L Quinn

(57) ABSTRACT

The present invention relates to athletic support garment having a support panel sized and shaped to encircle a person's waist or hips, and a crotch panel, the support panel having a front side, back side, top edge and bottom edge, the crotch panel having a front seamless portion sized and shaped to contain a person's genitals, a rear portion sized and shaped to cover the space between the buttocks but not restrict or impede movement of the person's legs and a strap portion joining the front portion and rear portion of the crotch panel, a first end of the crotch panel attached to the front side of the bottom edge of the support panel and a second end of the crotch panel attached to the rear side of the bottom edge of the support panel; wherein the support panel and crotch panel are formed from a fabric comprising a blend of a synthetic fiber and at least 10% of a stretchable fiber wherein the tensile strength of the fabric is sufficient to hold the genitals on top of and against the pubic bone above the crotch when in use.

15 Claims, 3 Drawing Sheets

ATHLETIC SUPPORT GARMENT

FIELD OF THE INVENTION

This invention relates to an athletic support garment for primarily men but may be used by women. In particular the present invention provides an athletic support garment that covers the male genitals. Moreover, the male genitals are held and supported over and against the pubic bone.

DESCRIPTION OF THE PRIOR ART

Athletic supports to protect and support the male genitals are known. Athletic supports are believed to be for all males that engage in sports or strenuous activity. It is believed that the athletic support helps relieve tension by keeping the male anatomy contained and keeping the testicles out of harms way. In contact sports, such as ice hockey and kickboxing, additional protection is provided by a hard triangular protective cup that emulates the natural shape of the male's flaccid organs. However in most known athletic support devices the level of said support is minimal due to general loose fit of these devices. When a protective cup is added, the movement of the cup over the genitals limits the protection to frontal blows. There is little or no protection from blows underneath and from behind, hence, the invention of the banana cup and its relatives.

No matter how the genitals have been covered in the past, comfort has always been an issue for the above reasons. Most men agree, that current devices are not that comfortable.

A common design involves a waistband with a descending pouch and a pair of straps having one end attached to the bottom of the pouch and the other end attached to the waistband. U.S. Pat. No. 4,679,554, U.S. Pat. No. 4,989,594 and U.S. Pat. No. 5,003,972 show this type of athletic support. In this design the genitals are not held and supported over and against the pubic bone and a protective cup in the pouch can move around inhibiting certain freedom of movement and in some instances, even cause injury.

Other designs have focused on incorporating a protective triangular cup within a sport brief. Examples of this type of product are shown in U.S. Pat. No. 5,157,793 and U.S. Pat. No. 5,819,323. These products used stretchable fabrics typically a cotton/lycra combination. Because this design contains one uniform fabric throughout, it does not offer enough strength to hold and support the cup over and against the pubic bone to hold the genitals securely in place. The material permits the cup and/or genitals to move around not providing adequate support or protection. In addition the cotton/lycra fabric is not able to remember or go back to its original shape after being stretched by long workouts or heavy exertion, sweating or repeated washings over time.

Compression shorts, made from nylon and lycra or spandex, have recently replaced the typical athletic support in many non-contact sports and activities. The compression shorts stretch as the person moves and with the addition of "moisture management" fabrics help the garment breathe and whisk moisture from the area, but do not address the loose fit and movement of the genitals causing concerns such as rubbing, chaffing and rashes.

SUMMARY OF THE INVENTION

It is an object of the invention to provide an athletic support garment having a design that elevates the genitals from between the athlete's legs and holds and supports them on top of and against the pubic bone in a single pouch-like seamless compartment.

It is a further object of the invention to provide an athletic support garment that can accommodate a newly designed protective cup so there is no interaction with the cup and the top of the athlete's thighs, thereby freeing the athlete to extend his/her range of motion to the utmost while maintaining maximum support, excellent comfort and ultimate protection.

Thus in accordance with the present invention there is provided athletic support garment having a support panel sized and shaped to encircle a person's waist or hips, and a crotch panel, said support panel having a front side, back side, top edge and bottom edge, said crotch panel having a front seamless portion sized and shaped to contain a person's genitals, a rear portion sized and shaped to cover the space between the buttocks but not restrict or impede movement of the person's legs and a strap portion joining the front portion and rear portion of said crotch panel, a first end of said crotch panel attached to the front side of the bottom edge of said support panel and a second end of said crotch panel attached to the rear side of the bottom edge of said support panel; wherein the support panel and crotch panel are formed from a fabric comprising a blend of a synthetic fiber and at least 10% of a stretchable fiber wherein the tensile strength of the fabric is sufficient to hold the genitals on top of and against the pubic bone above the crotch when in use. In a preferred embodiment the athletic support garment preferably includes a waistband sized and shaped to encircle a person's waist, said waistband with a bottom edge attached to the top edge of said support panel and made from a fabric with an equal or greater tensile strength than the support panel and crotch panel. The support panel and crotch panel are preferably made of a blend of a fiber selected from the group consisting of acetate, acrylic, lyocell, nylon, olefin, polyester and rayon fibers with more than 10% spandex/lycra fibers and preferably between 15%-30% spandex/lycra fibers. The first and second ends of the crotch panel are preferably centered on the front side and rear side respectively of the support panel. The athletic support garments of the present invention preferably have a pair of leg panels. Each of the leg panels has an upper edge and an inner edge. Where the waistband and support panel are combined, the upper edge of each leg panel is attached to the support panel and the inner edge of each leg panel is attached to one side of the crotch panel. Where the support panel is separate from the waistband, the upper edge of each leg panel is attached to a bottom edge of the support panel and the inner edge of each leg panel is attached to one side of said crotch panel. The leg panels are preferably made from a light-weight stretchable fabric with less tensile strength than the fabric used for the support panel.

Further features of the invention will be described or will become apparent in the course of the following detailed description.

BRIEF DESCRIPTION OF THE DRAWINGS

In order that the invention may be more clearly understood, a preferred embodiment thereof will now be described in detail by way of example, with reference to the accompanying drawings, in which.

DETAILED DESCRIPTION OF THE PREFERRED EMBODIMENT

Figure 1:
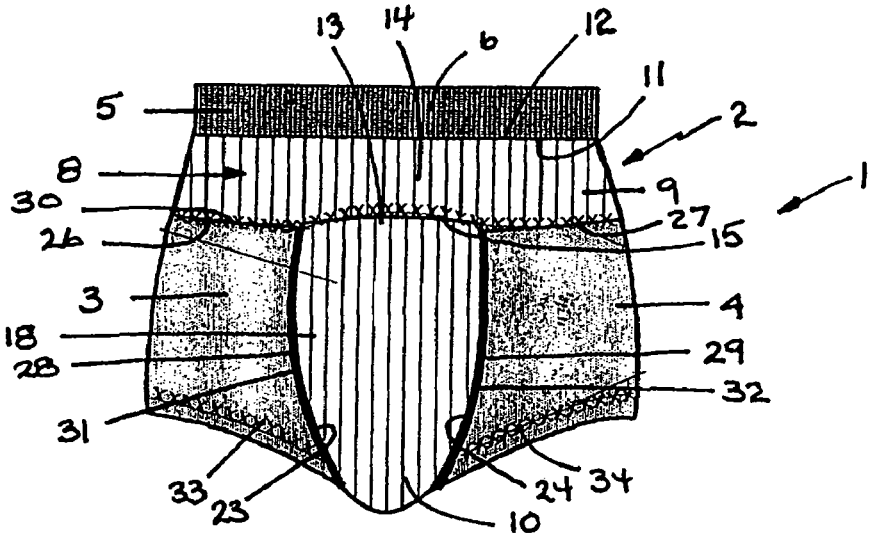
FIG. 1 is a front view of one embodiment of an athletic support garment in the form of briefs according to the present invention.
Figure 2:
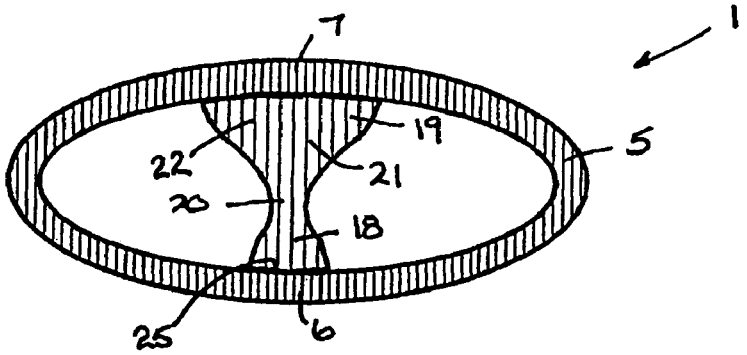
FIG. 2 is a top view of the athletic support garment of FIG. 1.
Figure 3:
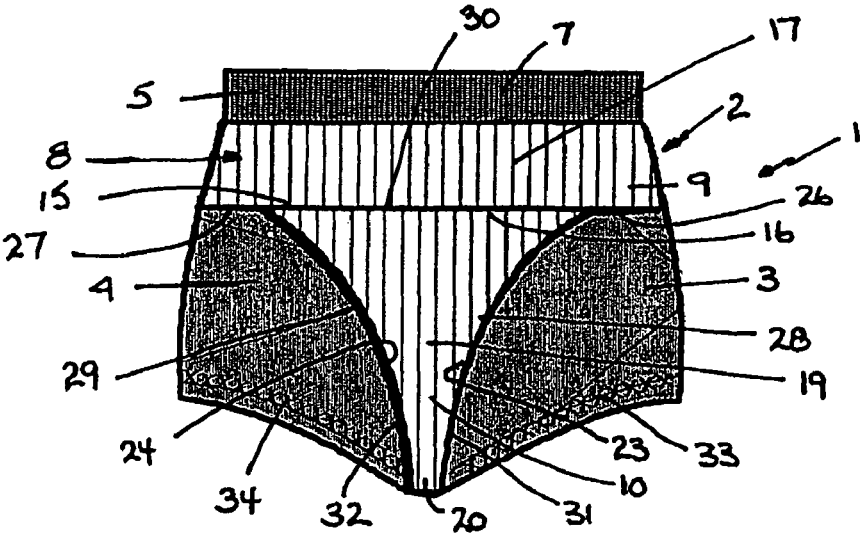
FIG. 3 is rear view of the athletic support garment of FIG. 1.

Referring to FIGS. 1 to 3, one embodiment of an athletic support garment according to the present invention in the form of a pair of briefs is generally indicated at 1. The athletic support garment 1 consists of an athletic support generally indicated at 2 and a pair of leg panels 3,4. The athletic support 2 preferably has a waistband 5 with a front side 6 and a rear side 7. A support panel 8 adapted and sized to fit around a person's waist and or hips is provided between the waistband 5 and a depending crotch panel 10. While the support panel 8 and waistband 5 are shown in the preferred embodiment as comprising two separate elements, the support panel and waistband could be formed as a single element without departing from the scope of the present invention. In the embodiment illustrated the support panel 8 has a body section 9. The body section 9 has a top side 11 attached to a bottom edge 12 of the waistband 5. A first end 13 of crotch panel 10 is attached to the front side 14 of the bottom edge 15 of the body section 9 of support panel 8. A second end 16 of crotch panel 10 is attached to the rear side 17 of the bottom edge 15 of the body section 9. The ends 13,16 of crotch panel 10 are preferably centered on the front side 14 and rear side 17 respectively of the bottom edge 15 of the body section 9.

In the embodiment shown the support panel 8 and crotch panel 10 are made from a strong and stretchable fabric that provides the support required and will retain its original shape after being stretched, worn or repeatedly washed. In the embodiment illustrated the support panel 8 and crotch panel 10 are made from a fabric comprising a blend of a synthetic fiber and at least 10% of a stretchable fiber wherein the tensile strength of the fabric is sufficient to hold the genitals in place on top of and against the pubic bone above the crotch. Preferably the stretchable fabric for the support panel 8 and crotch panel 10 is made of a blend of a fiber selected from the group consisting of acetate, acrylic, lyocell, nylon, olefin, polyester and rayon fibers with more than 10% spandex fibers or other elastic fibers such as Lycra™ or rubber. The preferred fabric for support panel 8 and crotch panel 10 is a four-way stretch 85% nylon 15% spandex blend with 1×1 or 2×1 rib. The waistband 5 is made from a fabric with an equal or greater tensile strength than the support panel 8 and crotch panel 10. The support panel 8 and crotch panel 10, by being made from a strong, stretchable fabric, will hold the genitals in place on top of and against the pubic bone above the crotch when in use. It is important that both the waistband 5 and support panel 8 are made from a fabric that while stretchable is very strong and resist pull. It is the reason the crotch panel 10 "locks" the genitals in place on top of and against the pubic bone above the crotch. If the waistband 5 was made from just a regular stretchy fabric, such as used on conventional underwear, with less tensile strength than support panel 8, it will not have the strength to hold the crotch panel 10 to obtain the locking effect. When a rib fabric is used for support panel 8 and crotch panel 10, the crotch panel 10 can grip and hold a protective cup in place better than a flat weave. In the preferred embodiment when a four way stretch fabric is used for support panel 8 and crotch panel 10, crotch panel 10 pulls the cup above the crotch locking it in place providing added comfort and protection over conventional athletic supports.

The crotch panel 10 has a front portion 18 sized and shaped to contain the genitals in a seamless pouch and preferably to hold a protective cup if required. A rear portion 19 of crotch panel 10 has a generally triangular configuration to cover the space between the buttocks but not restrict or impede movement of the legs. The extent to which the buttocks can be covered may vary without departing from the scope of the present invention provided the rear portion 19 does not restrict or impede movement of the legs. A strap portion 20 joins front portion 18 and rear portion 19 of crotch panel 10. The strap portion 20 can be similar to that of a thong or G-string or can mirror the front panel. A liner 21 may be provided on the inner surface 22 of crotch panel 10. Liner 21 may be may be formed of a soft, stretchable fabric such as a cotton/lycra blend or other soft performance stretchable fabrics for comfort. The liner performs primarily a comfort function and separates the ribbed crotch panel 10 in the preferred embodiment from the skin. While the edges of liner 21 are attached to the sides 23,24 of crotch panel 10, the top front edge 25 of liner 21 is unattached to permit a protective cup to be inserted if desired between the liner 21 and crotch panel 10. A top flap or under liner may be provided together with stitching along the bottom of the front portion 18 of the crotch panel 10 to retain the cup in place.

The waistband 5 is, as noted above, is preferably made from a stretchy fabric preferably different than the material of the support panel 8 and crotch panel 10 and a stronger material such as braided, knitted or woven waistband or sports elastic containing rubber fibers to provide strength and stretchability. Elastics can add stability to the waistband and prevent it from rolling.

In the embodiment shown, the athletic support garment 1 is provided with leg panels 3,4. Each of the leg panels 3,4 has an upper edge 26,27 and an inside edge 28,29. The upper edge 26,27 of each leg panel 3,4 is attached to the bottom edge 15 of the body section 9 of support panel 8. The inside edge 28,29 of each leg panel 3,4 is attached to one side 23,24 of crotch panel 10. The leg panels 3,4 are preferably made from a light-weight two way or four way stretchy solid or mesh fabric. In the embodiment illustrated the leg panels are made of a fabric blend having less than 8% spandex. Use of a stretchy fabric prevents the leg panels 3,4 from being too tight on the persons legs.

The length of the leg panels 3,4 may vary depending on the requirements of the activity from brief as shown in FIGS. 1 to 3 to full leg. In the embodiment shown the leg panels 3,4 keep the crotch panel 10 from going into the crack between the buttocks of a person. At the same time the strong, stretchable fabric of the crotch panel 10 pulls the front portion 18 of the crotch panel 10 to support the genitals and hold them in place on top of and against the pubic bone above the crotch. This combination provides better protection and comfort than prior designs. The comfort of the design is further enhanced in the preferred embodiment by the elimination of seams in the crotch panel by making it in one piece or the use of overly constrictive fabrics in the leg panels. To further enhance comfort the fabrics are preferably capable of moving moisture away from the body and are treated with a non-toxic bacterial agent to control unwanted bacteria to reduce rashes, itching, etc. to provide better hygiene. Performance fibers are typically breathable and move perspiration away from the body to the fabric's outer surface so it can evaporate quickly. Fabrics made with performance fibers are particularly suitable for the present invention.

The seams 30 along the bottom edge 15 of body section 9 of support panel 8 preferably use a flat lock stitch to permit the material to stretch without breaking the seam 30. The seams 31,32 along the sides 23,24 of crotch panel 10 are preferably reinforced with an elastic. The seams 33,34 along the bottom edge 35,36 of leg panels 3,4 preferably use a flat lock stitch to permit the material to stretch without breaking the seams 33,34.

Figure 4:
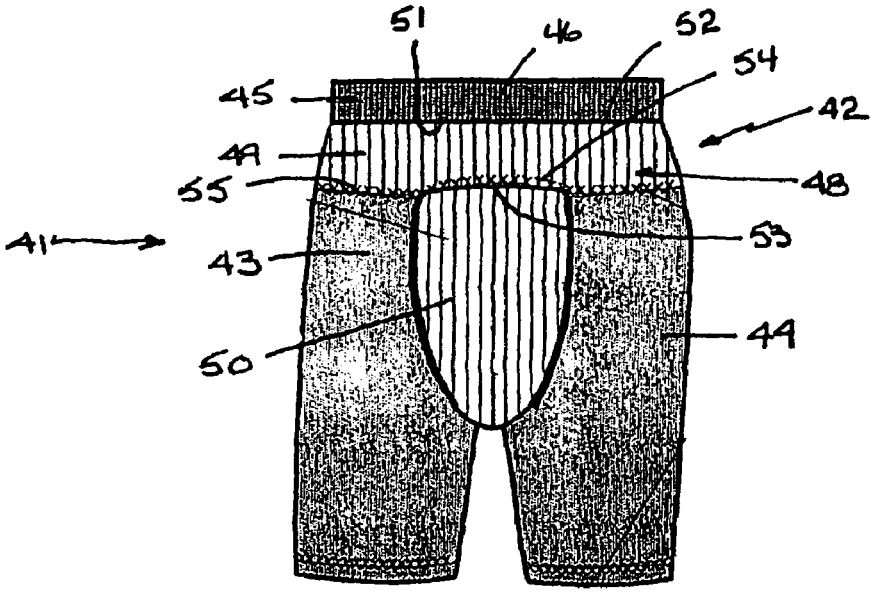
FIG. 4 is a front view of another embodiment of an athletic support garment in the form of shorts with a long leg panel according to the present invention.
Figure 5:
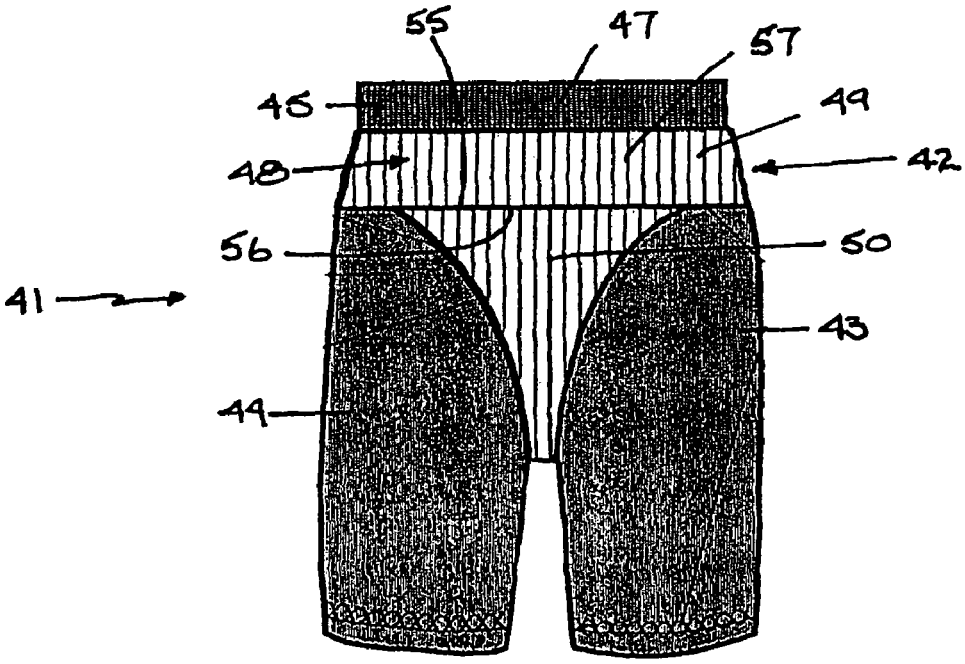
FIG. 5 is rear view of the athletic support garment of FIG. 4.

FIGS. 4 and 5, illustrated a second embodiment of an athletic support garment generally indicated at 41. The athletic support garment 41 is in the form of a long-leg short having an athletic support generally indicated at 42 and a pair of leg panels 43,44. The athletic support 42 preferably has a waistband 45 with a front side 46 and a rear side 47 and a support panel 48. The support panel 48 has a body section 49 having a top side 51 attached to a bottom edge 52 of waistband 45. A first end 53 of a crotch panel 50 is attached to the front side 54 of the bottom edge 55 of the body section 49. A second end 56 of the crotch panel 50 is attached to the rear side 57 of the bottom edge 55 of the body section 49. The ends 53,56 of crotch panel 50 are preferably centered on the front side 54 and rear side 57 respectively of the bottom edge 55 of the body section 49.

The construction and design of athletic support garment 41 is substantially the same as the athletic support garment 1 illustrated in FIGS. 1 to 3 except that the leg panels 43, 44 are longer. The leg panels 43, 44 of athletic short 41 extend to just above the knee.

Figure 6:
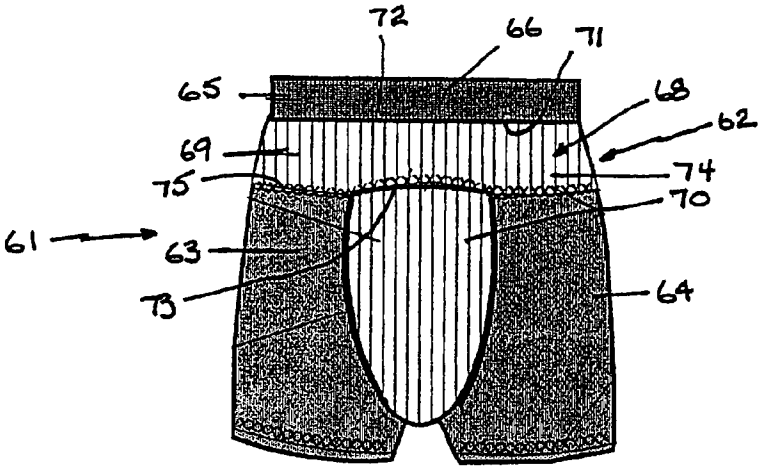
FIG. 6 is a front view of another embodiment of an athletic support garment in the form of shorts with a short leg panel according to the present invention.
Figure 7:
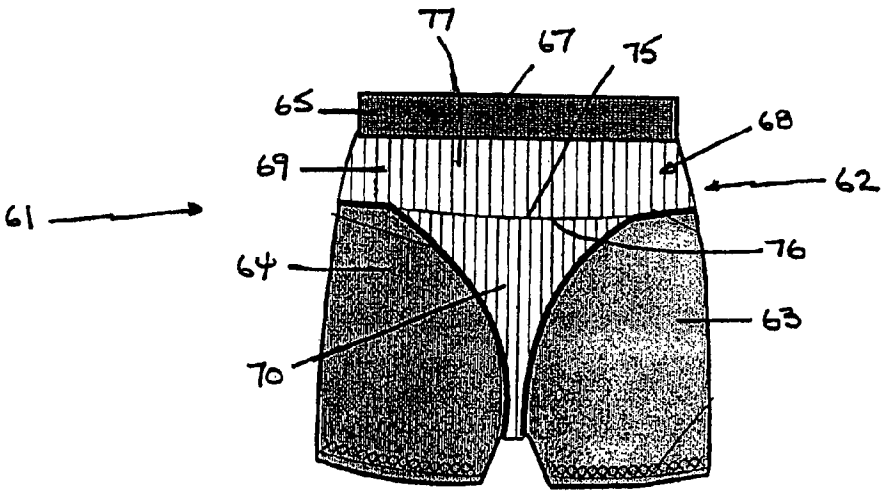
FIG. 7 is a rear view of the athletic support garment of FIG. 6.

FIGS. 6 and 7, illustrate another embodiment of an athletic support garment generally indicated at 61. The athletic short 61 is in the form of a short-leg short having an athletic support generally indicated at 62 and a pair of leg panels 63,64. The athletic support 62 preferably has a waistband 65 with a front side 66 and a rear side 67 and a support panel 68. The support panel 68 has a body section 69 having a top side 71 attached to a bottom edge 72 of the waistband 65. A first end 73 of a crotch panel 70 is attached to the front side 74 of the bottom edge 75 of the body section 69. A second end 76 of the crotch panel 70 is attached to the rear side 77 of the bottom edge 75 of the body section 69. The ends 73,76 of crotch panel 70 are preferably centered on the front side 74 and rear side 77 respectively of the bottom edge 75 of the body section 69.

The construction and design of athletic support garment 61 is substantially the same as the athletic support garments 1,41 illustrated in FIGS. 1 to 3 and FIGS. 4 and 5 except that the leg panels 63, 64 are longer than for athletic support garment 1 but shorter than for athletic support garment 41. The leg panels 63, 64 of athletic support garment 61 extend to about mid thigh.

The athletic support garments of the present invention can be used for a variety of sports including hockey, baseball, soccer, lacrosse, cycling, wrestling, basketball, track and field, speed skating, skiing, football etc. where support and containment of the male genitals is required while permitting freedom of movement of the legs. The present invention can be incorporated into a short as illustrated or incorporated into a body suit. The garments of the present invention can be designed to be worn under other equipment such as in sports like hockey or as part of the outer garment as in track and field or speed skating. Accessories can be attached to the athletic shorts of the present invention, again depending on the sport or activity for which they are intended. For example if designed for hockey, the athletic support garment can be provided with clips or other fastening means such as Velcro strips to hold up the hockey socks.

Having illustrated and described a preferred embodiment of the invention and certain possible modifications thereto, it should be apparent to those of ordinary skill in the art that the invention permits of further modification in arrangement and detail. For example the waistband and body section of the support panel of the athletic support garment can be combined into a single component. The front portion and rear portion of the crotch panel are then adapted (extended) if necessary to connect to the bottom edge of the waistband. Similarly the upper edge of the leg panels would then attach to the bottom edge of the waistband. All such modifications are covered by the scope of the invention.

The invention claimed is:

1. A garment for providing protection and support for the genitals of a male wearer, the garment comprising:

a waistband made of elastic and disposed to encircle the wearer's torso at or near his waist when the garment is in use;

a support panel of different material from the waistband made of a weave of stretchable and non-stretchable fibers, the support panel being attached to the waistband so as to encircle the wearer's torso below the waistband when the garment is in use, thereby supporting the garment against the wearer's hips;

a crotch elevating panel comprising a crotch seamlessly joined to a single strap portion, both made of a weave of stretchable and non-stretchable fibers, the crotch portion being attached to the support panel and shaped to contain the wearer's genitals, the strap portion connecting the crotch portion to the support panel at a position opposite to where the crotch portion is attached, the strap portion being sufficiently narrow so that when worn between the wearer's legs it does not impair their movement; and two leg panels, one each on the left and right side of the garment, the leg panels being made of a light-weight fabric and attached to the support panel and the crotch and strap portions of the crotch elevating panel on each side of the garment so as to leave an opening for each leg of the wearer;

wherein the crotch portion and the strap portion are disposed so that the crotch elevating panel draws the genitals of the wearer upwards from between the wearer's legs when the garment is in use, thereby holding and supporting the genitals against the wearer's pubic bone.

2. The garment of claim 1, wherein the support panel and the crotch elevating panel are made of a weave of an unstretchable fiber selected from acetate, acrylic, lyocell, nylon, olefin, polyester, and rayon, and the stretchable fiber spandex.

3. The garment of claim 1, wherein the support panel and the crotch elevating panel are made from a weave of nylon with about 10% spandex and having a 1×1 rib weave.

4. The garment of claim 1, wherein the crotch portion of the crotch elevating panel is a single pouch-like seamless compartment.

5. The garment of claim 1, wherein the crotch elevating panel is configured to contain a protective cup in a separate compartment.

6. The garment of claim 1, wherein the crotch portion is lined.

7. The garment of claim 1, wherein the leg panels are configured to keep the strap portion from going between the wearer's buttocks without preventing the crotch elevating panel from elevating and supporting the genitals of the wearer in the manner specified.

8. The garment of claim 1, wherein the leg panels are made of a two way or four way stretchable solid or mesh fabric containing less than about 8% spandex.

9. The garment of claim 1, wherein the leg panels are brief, mid thigh, or full thigh in length.

10. The garment of claim 1, wherein the strap portion of the crotch elevating panel flares before its connection to the opposite side of the support panel so as to form a rear portion that does not impair movement of the wearer's legs or buttocks.

11. The garment of claim 1, designed to be worn under other equipment.

12. The garment of claim 1, which is part of an outer garment.

13. The garment of claim 1, made of a performance fabric that moves perspiration away from the wearer's body to the fabric's outer surface.

14. The garment of claim 1, adapted for use in an athletic activity selected from hockey, baseball, football, soccer, lacrosse, basketball, tennis, squash, track and field, cycling, speed skating, skiing, and wrestling.

15. A garment for providing support for the genitals of a male wearer during athletic activity, the garment comprising:

a waistband made of elastic and disposed to encircle the wearer's torso at or near his waist when the garment is in use;

a support panel made of a weave of stretchable and non-stretchable fibers, the support panel being attached to the waistband so as to encircle the wearer's torso below the waistband when the garment is in use, thereby supporting the garment against the wearer's hips;

a one-piece crotch elevating panel made of a weave of stretchable and non-stretchable fibers, comprising a crotch portion joined to a single strap portion, the crotch portion being attached to the support panel and having a pouch-like seamless compartment, the strap portion connecting the crotch portion to the support panel at a position opposite to where the crotch portion is attached by way of a rear portion sized and shaped not to restrict or impede movement of the wearer's legs; and two leg panels being made of a light-weight fabric, and attached to the support panel and the crotch and strap portions of the crotch elevating panel one on each side of the garment so as to leave an opening for each leg of the wearer;

wherein the crotch elevating panel is disposed to draw the genitals of the wearer upwards from between the wearer's legs when the garment is in use.

* * * * *